United States Patent [19]

Dellian et al.

[11] 3,957,434

[45] May 18, 1976

[54] COLORING SYNTHETIC FIBERS WITH DIPHENYLCARBINOL DYEING ASSISTANTS

[75] Inventors: Kurt A. Dellian; Jayanti V. Isharani, both of Greensboro, N.C.

[73] Assignee: Ciba-Geigy Corporation, Ardsley, N.Y.

[22] Filed: Dec. 16, 1974

[21] Appl. No.: 532,964

[52] U.S. Cl. ..... 8/173; 8/93

[51] Int. Cl.[2] ..... C09B 67/00; D06P 1/64; D06P 5/04

[58] Field of Search ..... 8/93, 173; 260/618 B

[56] References Cited

UNITED STATES PATENTS

| | | | |
|---|---|---|---|
| 2,394,688 | 2/1946 | Heyman | 8/173 |
| 2,881,045 | 4/1959 | Mecco et al. | 8/173 |
| 3,467,484 | 9/1969 | Hermes | 8/173 |

OTHER PUBLICATIONS

Modern Plastics Encyclopedia, 1968, McGraw–Hill, N.Y., Sept.1967, pp. 496–498.

*Primary Examiner*—Donald E. Czaja
*Assistant Examiner*—H. H. Fletcher
*Attorney, Agent, or Firm*—Joseph G. Kolodny; Edward McC. Roberts; Prabodh I. Almaula

[57] ABSTRACT

This invention relates to an improvement in the process for dyeing polyester or polyamide textile fibers with the dyestuff using a carrier, the carrier comprising a diphenylcarbinol of the formula

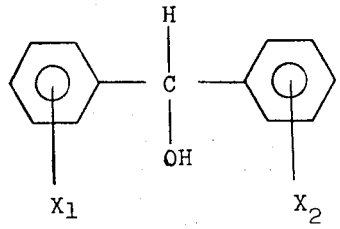

where $X_1$ and $X_2$ independently are hydrogen, halogen or lower alkyl.

5 Claims, No Drawings

COLORING SYNTHETIC FIBERS WITH DIPHENYLCARBINOL DYEING ASSISTANTS

This invention relates to a process for dyeing and printing polyester and polyamide using a carrier comprising a diphenylcarbinol of the formula:

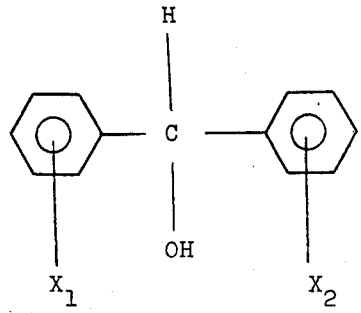

where $X_1$ and $X_2$ independently are hydrogen, halogen or lower alkyl of 1 to 4 carbon atoms.

Of particular interest are those compounds in which $X_1$ and $X_2$ independently are hydrogen, chloro or methyl. When either $X_1$ or $X_2$ is halogen, chlorine or bromine is preferred, particularly chlorine. When either $X_1$ or $X_2$ is lower alkyl, methyl or ethyl is preferred, particularly methyl.

The instant carrier emulsions are accordingly suitable for use in dyeing and printing the following fibers and blends, among others: polyesters (disperse dyeable), polyesters (disperse and cationic dyeable), Triacetate, Modacrylic, polyamide and blends of such fibers with wool, cellulose fibers, polyamide fibers, acrylic fibers, glass fibers and mineral fibers.

Polyester fibers for use in accordance with this invention can generally be defined as synthetic polymeric polyesters such as the highly polymeric linear polyesters, the molecules of which have reoccurring monomeric units connected by ester linkages. Dibasic acids, for example, aromatic acids, such as terephthalic acid, diphenyl-4,4'-dicarboxylic acid and/or diphenylsulfone-4,4'-dicarboxylic acid, dihydroxy compounds such as glycols, including ethylene glycol, diethylene glycol, triethylene glycol, propylene glycol, butylene glycol, mixtures thereof and other diols including 1,4-cyclohexyldiol can be used as the monomers to form the polymeric polyesters. Polyesters that are sold commercially include Dacron, Terylene, Fortrel, Trevira, Terlanca, Kodel, Vycron, etc. Representative polyesters are disclosed for example in U.S. Pat. No. 2,901,466 and British Pat. Nos. 578,079; 579,462; 588,497 and 596,688.

Polyamide fibers for use in accordance with this invention include the polycarbonamide fibers and especially those linear polyamide fibers containing at least 70% by weight of the repeating unit

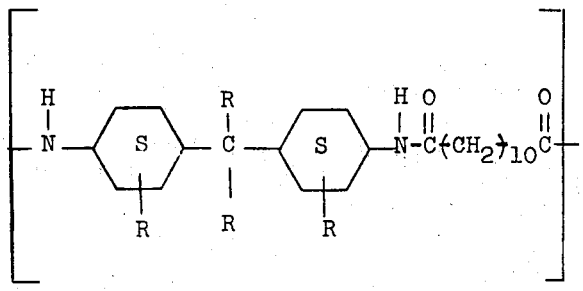

wherein R is the same or different member of the class consisting of hydrogen and methyl. Representative fibers as well as the above discussed structure is detailed in U.S. Pat. No. 3,393,210 to Speck which specification is incorporated by reference.

As exemplary of these materials is the polyamide polycondensate of 4,4'-diaminodicyclohexamethane with dodecanedioic acid. Such material is commercially available from DuPont, depending on finish, denier, etc., as Nylon Types 472 (trademark as Qiana) and 473. The latter material has a silk-like handle, a density of 1.04 and a crystallinity similar to polyester fibers as reported by A. Hiddiar, Review of Prograss in Coloration, vol. 1, page 64, June 1967–September 1969.

The carrier emulsions of the present invention are useful with the following dye classes, among others:

Anionic dyes; including acid dyes, 1:1 metal complex dyes, 1:2 metal complex dyes, mordant dyes, direct dyes, after-treated direct dyes, vat dyes, sulfur dyes and azoic dyes;

Cationic (basic) dyes; and

Nonionic (disperse) dyes.

Preferred dyes for use with the present invention include:

| | |
|---|---|
| Acid Yellow 17 | C.I. No. 18965 |
| Acid Yellow 23 | C.I. No. 19140 |
| Acid Yellow 40 | C.I. No. 18950 |
| Acid Yellow 73 | C.I. No. 45350 |
| Acid Red 14 | C.I. No. 14720 |
| Acid Red 35 | C.I. No. 17045 |
| Acid Red 73 | C.I. No. 27290 |
| Acid Red 85 | C.I. No. 22245 |
| Acid Red 88 | C.I. No. 15620 |
| Acid Blue 25 | C.I. No. 62055 |
| Acid Blue 40 | C.I. No. 62125 |
| Disperse Yellow 23 | C.I. No. 26070 |
| Disperse Yellow 54 | (No C.I. No. assigned) |
| Disperse Blue 3 | C.I. No. 61505 |
| Disperse Blue 7 | C.I. No. 62500 |
| Disperse Blue 27 | C.I. No. 60767 |
| Disperse Red 55 | (No. C.I. No. assigned) |
| Disperse Red 60 | (No. C.I. No. assigned) |
| Basic Yellow 11 | C.I. No. 48055 |
| Basic Yellow 21 | (No C.I. No. assigned) |
| Basic Yellow 28 | (No C.I. No. assigned) |
| Basic Yellow 32 | (No C.I. No. assigned) |
| Basic Yellow 45 | (No C.I. No. assigned) |
| Basic Orange 21 | C.I. No. 48035 |
| Basic Orange 22 | C.I. No. 48040 |
| Basic Red 13 | C.I. No. 48015 |
| Basic Red 15 | (No C.I. No. assigned) |
| Basic Red 18 | (No C.I. No. assigned) |
| Basic Red 22 | (No C.I. No. assigned) |
| Basic Red 46 | (No C.I. No. assigned) |
| Basic Blue 3 | C.I. No. 51005 |
| Basic Blue 41 | C.I. No. 52015 |
| Basic Blue 47 | C.I. No. 61111 |
| Basic Blue 42 | (No C.I. No. assigned) |
| Basic Blue 43 | (No C.I. No. assigned) |
| Basic Blue 57 | (No C.I. No. assigned) |

The dyeing of the hydrophobic synthetic fibers described above is generally effected by methods which include the use of the dye carrier in the presence of the swelling agent. These materials tend to open the pores of the hydrophobic fiber material and permit the dye to enter and remain there in a colorfast manner. The carriers described herein have a high efficiency, do not affect the fastness properties of the dyed fiber, do not degrade or discolor the fibers, the carriers are readily removable after dyeing and are stable under conditions present in the dyebath. Further, the carriers are compatible with the dyes employed, leave no residual odor in the finished textile, are biodegradable having a nonpollutant character and are characterized by low toxicity and skin irritability. The carriers described herein increase the utilization and effectiveness of the dyestuffs and permit effective drawing rate of the dyestuffs while assisting in permitting good fastness with uniform shades in the dyeing operation. In addition, the carriers described herein offer good yield at normal dyeing temperature, tend to be low foaming and are compatable with a variety of dyestuffs including dispersed acid basic and various combinations thereof.

The carriers described herein can be employed in conjunction with such conventional dyeing techniques as beck, jig, paddle, padder, package machine and other conventional dyeing methods.

In U.S. Pat. No. 2,394,688, a large number of possible assistants are recited and included in the list is benzhydrol. These assistants are contemplated as useful with disperse dyestufs on vinyl polymers such as polyvinylchloride and copolymers of vinylchloride and vinyl acetate. There is no exemplification, however, of the use of benzhydrol in this patent. The closest structurally related compound to those of the instant invention specifically exemplified in U.S. Pat. No. 2,394,688 is benzophenone. However, benzophenone tends to affect the light fastness of dyed materials whereas the instant assistants are much superior. Moreover, phenolic type dye assistants, such as $\beta$-naphthol and o-hydroxydiphenyl are odorific, affect light fastness and tend to be skin irritants.

The instant dye assistant compounds are surprisingly superior in that they render dyes more light fast, are less odorific and are not skin irritable as compared to the prior art.

Dye condentrations for use in accordance with this invention can range from 0.01 to about 10% based upon the weight of the textile being dyed.

The compositions useful herein may contain from about 5 to 15% by weight of an emulsifier which can be a nonionic or anionic wetting agent or a combination thereof.

Typical anionic surfactants which are useful include the salts of long-chain carboxylic, sulfonic and sulfuric acid esters, alkylated aromatic sulfonic acids and salts of longchain amines. Thus there are the alkyl-aryl sulfonates, the alkyl sulfonates, the sulfonated fatty acid amides, and the sulfonated monoglycerides. The organic base, ammonium, sodium and potassium salts of the anionic type surfactants can be used.

The nonionic type surfactants useful herein can be described as those surfactants which do not ionize in solution but owe their water solubility to unionized polar groups such as hydroxy or other linkages. The main types of surfactants falling within this category are the polyoxyethylene ethers of the higher fatty alcohols and alkyl phenols; the polyethylene glycols of fatty acids; fatty alkylol amide condensation products; polymers of ethylene and proplyene oxides; compounds formed by the addition of propylene oxide to ethylene diamide, followed by the addition of ethylene oxide; fatty acid ethylene oxide condensation products; condensation products of ethylene oxide and a fatty acid ester of a polyhydric alcohol; and the products prepared by heating together a higher fatty acid with a diethamol amine.

Illustrative of some of the emulsifying agents described above are the following materials, described in U.S. Pat. No. 3,787,181;

$C_8$ to $C_{24}$—COOM  $C_8$ to $C_{24}OSO_2OM$
$C_{12}$ to $C_{18}$—$SO_3M$  $C_3$ to $C_{18}$—Ar—$SO_3M$
$C_1$ to $C_{18}$—$(C_6H_4)$—$(OCH_2CH_2)_{1-10}$—$OSO_2M$ $$C_1 \text{ to } C_{18}-(C_6H_4)-(OCH_2CH_2)_{1-10}-\overset{\overset{\displaystyle O}{\|}}{P}\begin{matrix}OM\\OM\end{matrix}$$

$C_1$ to $C_{18}$—$(C_6H_4)$—$(OCH_2CH_2)_{4-40}$—OH
$C_8$ to $C_{24}$—$(OCH_2CH_2)_{4-40}$—OH
$C_8$ to $C_{24}$—$(OCH_2CH_2)_{1-4}$—$OSO_3M$ $$C_8 \text{ to } C_{24}-(OCH_2CH_2)_{1-4}-O-\overset{\overset{\displaystyle O}{\|}}{P}\begin{matrix}OM\\OM\end{matrix}$$

where M is a cationic such as sodium, potassium, ammonium or a derivative of ammonia; and Ar is an aromatic nucleus selected from benzene, naphthalene or anthracene.

Representative specific emulsifying agents which can be employed are Turkey red oil, sodium lauryl sulfate, sodium dodecyl benzene solfonate, triethanolamine salt of lauryl sulfate, ethoxylated nonylphenol sulfate sodium salt, sodium octadecyl benzene sulfonate, sodium octadecyl sulfate, sodium salt of the oleic acid amide of methyl taurine, and condensation products obtained by condensing polyethylene glycol with coconut fatty acids and oleic acids, as well as the triethanolamine and ammonium hydroxyid salts of oleic, stearic and tallow fatty acids. An example of preferred emulsifying agent is the ammonium salt of (15–18 mole) ethoxylated nonylphenol sulfate.

There can be added to the compositions of this invention compatible materials which do not effect their basic and novel characteristics. Among such materials are coloring agents, including dyes and pigments, fillers, antioxidants, antistatic agents, stabilizers, antifoaming agents, and solvents. The quantity of such additives is usually limited to about 50 weight percent of total composition.

Emulsion suitable for use in accordance with the instant invention may be prepared by methods known in the art.

For example, the emulsifier may be mixed with water and the diphenylcarbinol added thereto with stirring. To this emulsified composition there is added additional water and the dyestuff to obtain a dyebath composition.

The amount of dye present in the dyebath composition may vary between wide limits.

Thus the dyebath composition may contain from about 0.01 to about 10% by weight dyestuff, about 0.5 to about 15% by weight emulsifier, about 40 to about 90% by weight benzhydrol and the remainder water.

In the following illustrative Examples all parts are by weight unless otherwize indicated.

EXAMPLE 1

A polyethyleneterephthalate fiber is dyed in a liquor ratio of 40:1 in an aqueous dyebath containing:

8% of an emulsion consisting of:

1. 70% of Benzhydrol (diphenylcarbinol)
2. 15% of the ammonium salt of (15–18 mole) oxethylated nonylphenol sulfate, and
3. 15% water.

A dyestuff in an amount of 3% by weight of the fabric of the following formula is added:

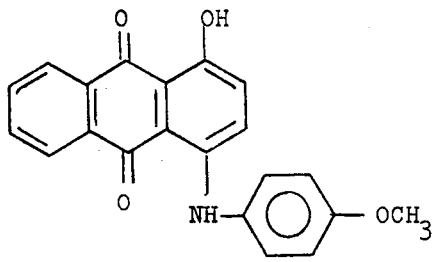

A reddish blue shade of very good fastness properties is obtained.

EXAMPLE 2

The materials and techniques of Example 1 were duplicated except an 8% emulsion of a 70% active ingredient based on dimethyl-diphenyl carbinol (ditolylcarbinol, isomeric mixture) and 2.5% of a dyestuff of the following formula was used:

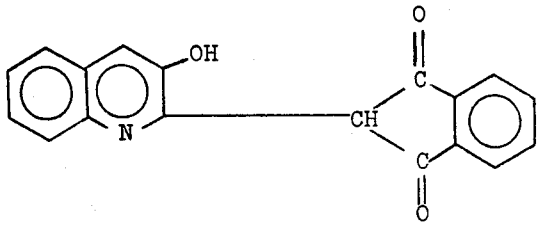

A deep yellow shade is obtained with good all-round fastness properties.

EXAMPLE 3

A polyethylene fabric is printed with a print paste containing 20g/kg of the dyestuff used in Example 1. 30g/kg mono-o-chlorodiphenylcarbinol and a thickener of starch etherlocust bean gum is used. The print is submitted to a 20-minute HT-steaming. A fast blue shade is obtained.

EXAMPLE 4

A nylon type 472 (trade marked as Qiana) is used instead of polyethylentherephthalate fabric according to Example 1. Dyeing is executed at 255°F over 45 minutes. A full blue shade is obtained with good fastness properties.

I claim:

1. In a process for dyeing polyester or synthetic polyamide textile fibers with a dyestuff using a carrier, the improvement which comprises conducting said process in the presence of a carrier composition which is 40 to 90% by weight a diphenylcarbinol carrier of the formula

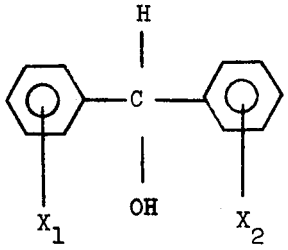

wherein $X_1$ and $X_2$ are independently selected from the group consisting of hydrogen, halogen and lower alkyl.

2. The process of claim 1, wherein $X_1$ and $X_2$ are hydrogen.

3. The process of claim 1, wherein $X_1$ and $X_2$ are methyl.

4. The process of claim 1, wherein $X_1$ is hydrogen and $X_2$ is chloro.

5. A dyebath emulsion comprising 0.01 to about 10% by weight dyestuff; about 0.5 to about 15% by weight anionic or nonionic emulsifier or mixtures thereof; about 40 to 95% by weight of a diphenylcarbinol carrier of the formula

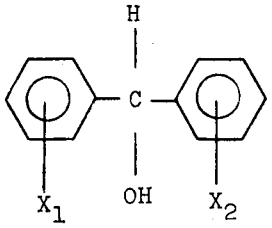

wherein $X_1$ and $X_2$ are independently selected from the group consisting of hydrogen, halogen and lower alkyl; and the remainder water.

* * * * *